US010421579B2

(12) United States Patent
Shafer et al.

(10) Patent No.: US 10,421,579 B2
(45) Date of Patent: Sep. 24, 2019

(54) TORNADO DISPLAY

(71) Applicant: General Packaging Products, Inc., Medina, OH (US)

(72) Inventors: Michael Shafer, Wadsworth, OH (US); Robert Berg, Wadsworth, OH (US)

( * ) Notice: Subject to any disclaimer, the term of this patent is extended or adjusted under 35 U.S.C. 154(b) by 83 days.

(21) Appl. No.: 15/679,701

(22) Filed: Aug. 17, 2017

(65) Prior Publication Data

US 2018/0050836 A1 Feb. 22, 2018

Related U.S. Application Data

(60) Provisional application No. 62/375,930, filed on Aug. 17, 2016.

(51) Int. Cl.

| | |
|---|---|
| ***B65D 5/42*** | (2006.01) |
| ***B65D 5/02*** | (2006.01) |
| ***A47F 5/11*** | (2006.01) |
| ***B65D 5/52*** | (2006.01) |
| ***B65D 5/04*** | (2006.01) |

(52) U.S. Cl.

CPC ..... *B65D 5/5213* (2013.01); *A47F 5/112* (2013.01); *B65D 5/029* (2013.01); *B65D 5/04* (2013.01); *B65D 5/4266* (2013.01)

(58) Field of Classification Search

CPC . B65D 5/52; B65D 5/029; B65D 5/02; B65D 5/0254; B65D 5/10; B65D 5/74; B65D 5/08; B65D 5/42; A47F 5/112; G09F 19/08; G09F 15/0062; Y10S 206/822; Y10S 52/10

USPC ..... 229/116.1

See application file for complete search history.

(56) References Cited

U.S. PATENT DOCUMENTS

| | | | | | |
|---|---|---|---|---|---|
| 1,896,721 | A | * | 2/1933 | Richards | B65D 5/52 108/115 |
| 2,150,453 | A | * | 3/1939 | Mulford | B65D 5/50 206/423 |
| 2,176,912 | A | * | 10/1939 | Luckett | B65D 5/38 206/264 |
| D178,925 | S | * | 10/1956 | March | D9/430 |
| 3,079,062 | A | * | 2/1963 | Craddock | B65D 5/02 206/822 |
| 3,237,838 | A | * | 3/1966 | Elias | B65D 5/326 229/104 |
| 3,269,644 | A | * | 8/1966 | Bump | B65D 5/742 222/572 |

(Continued)

*Primary Examiner* — Brian D Nash

(74) *Attorney, Agent, or Firm* — Kevin Keener; Keener and Associates, P.C.

(57) ABSTRACT

A blank of material to be folded into a product display container is disclosed. The blank is substantially rectangular in shape and has a first edge, a second edge opposite of the first edge, a third edge disposed adjacent to the first edge and the second edge and a fourth edge disposed opposite the third edge. The blank comprises a tab disposed adjacent to the fourth edge; a plurality of perpendicular folds, wherein each perpendicular fold extends across the width of the blank and is disposed substantially perpendicular to the first edge and the second edge; and a plurality of angular folds, wherein each angular fold extends across the width of the blank and is disposed at a non-perpendicular angle with respect to the first edge and the second edge. The blank is utilized to make a tornado shaped product display.

8 Claims, 3 Drawing Sheets

(56) References Cited

U.S. PATENT DOCUMENTS 3,447,732 A * 6/1969 Deckys ..... B65D 5/745 229/217
3,844,470 A * 10/1974 Rohde ..... B65D 5/029 229/116
3,912,156 A * 10/1975 May ..... B65D 5/029 229/116.1
4,017,017 A * 4/1977 Vos ..... B65D 5/008 229/101
4,063,679 A * 12/1977 Henry ..... B65D 5/029 229/108
4,191,324 A * 3/1980 Kitagawa ..... B65D 5/3607 229/104
4,260,097 A * 4/1981 Nold ..... B65D 5/029 229/108
4,408,689 A * 10/1983 Daniels ..... B65D 5/42 206/320
4,691,858 A * 9/1987 Peer, Jr. ..... B65D 5/065 222/529
4,792,470 A * 12/1988 Clark ..... A47C 5/005 108/161
5,098,014 A * 3/1992 Perkins ..... B65D 5/46112 229/116
D391,097 S * 2/1998 Eichert ..... D6/678
5,791,555 A * 8/1998 Kanter ..... B65D 5/001 229/157
5,819,453 A * 10/1998 Eichert ..... A47F 5/025 40/411
6,206,279 B1 * 3/2001 Countee ..... B65D 5/0005 229/117.27
D525,762 S * 8/2006 Evans ..... D1/125
D549,587 S * 8/2007 Lestelle ..... D9/520
D560,377 S * 1/2008 Jouin ..... D6/351
D566,573 S * 4/2008 Lestelle ..... D9/520
D586,208 S * 2/2009 Evans ..... D9/432
D592,051 S * 5/2009 Casebasse ..... D9/431
D646,721 S * 10/2011 Dingler ..... D19/73
8,479,972 B2 * 7/2013 Craft ..... B65D 5/029 229/101
10,022,943 B2 * 7/2018 Scharfenort ..... B65D 5/745

* cited by examiner

TORNADO DISPLAY

PRIORITY

This application claims priority to U.S. Provisional Application Ser. No. 62/375,930, filed on Aug. 17, 2017, the disclosure of which is hereby incorporated by reference.

FIELD OF THE INVENTION

This application pertains generally to product displays and more particularly to a specialized blank and product display.

BACKGROUND OF INVENTION

Different product displays are known. A conventional product display is no more than an open box in a cuboid shape with a vertical back displaying information regarding the product. This configuration has simple functionality but lacks distinctiveness required to gain a customer's attention in today's retail location. What is needed is a distinctive product display which functions to hold products but has a unique and distinctive shape to grab the attention of consumers.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The invention is directed to a blank of material to be folded into a product display container. The blank is substantially rectangular in shape and has a first edge, a second edge opposite of the first edge, a third edge disposed adjacent to the first edge and the second edge and a fourth edge disposed opposite the third edge. The first edge and the second edge extend along a length of the blank. The third edge and the fourth edge extend along a width of the blank. The blank comprises a tab disposed adjacent to the fourth edge; a plurality of perpendicular folds, wherein each perpendicular fold extends across the width of the blank and is disposed substantially perpendicular to the first edge and the second edge; and a plurality of angular folds, wherein each angular fold extends across the width of the blank and is disposed at a non-perpendicular angle with respect to the first edge and the second edge. A first end of each angular fold is disposed at a first end of a first respective perpendicular fold along the first edge. A second end of each of the angular folds is disposed at a second end of a second respective perpendicular fold along the second edge.

The blank may comprise four angular folds. The blank may comprise four perpendicular folds. The blank may further comprise one or more apertures.

The blank may further comprise a first surface and a second surface disposed on an opposite side from the first surface. Each of the angular folds project outward from the first surface. Each of the perpendicular folds project outward from the second surface.

Still other embodiments of the present invention will become readily apparent to those skilled in this art from the following description wherein there is shown and described the embodiments of this invention, simply by way of illustration of the best modes suited to carry out the invention. As it will be realized, the invention is capable of other different embodiments and its several details are capable of modifications in various obvious aspects all without departing from the scope of the invention. Accordingly, the drawing and descriptions will be regarded as illustrative in nature and not as restrictive.

BRIEF DESCRIPTION OF THE DRAWINGS

Various exemplary embodiments of this invention will be described in detail, wherein like reference numerals refer to identical or similar components, with reference to the following figures, wherein.

DETAILED DESCRIPTION OF THE PREFERRED EMBODIMENT

The claimed subject matter is now described with reference to the drawings. In the following description, for purposes of explanation, numerous specific details are set forth in order to provide a thorough understanding of the claimed subject matter. It may be evident, however, that the claimed subject matter may be practiced with or without any combination of these specific details, without departing from the spirit and scope of this invention and the claims.

Figure 1:
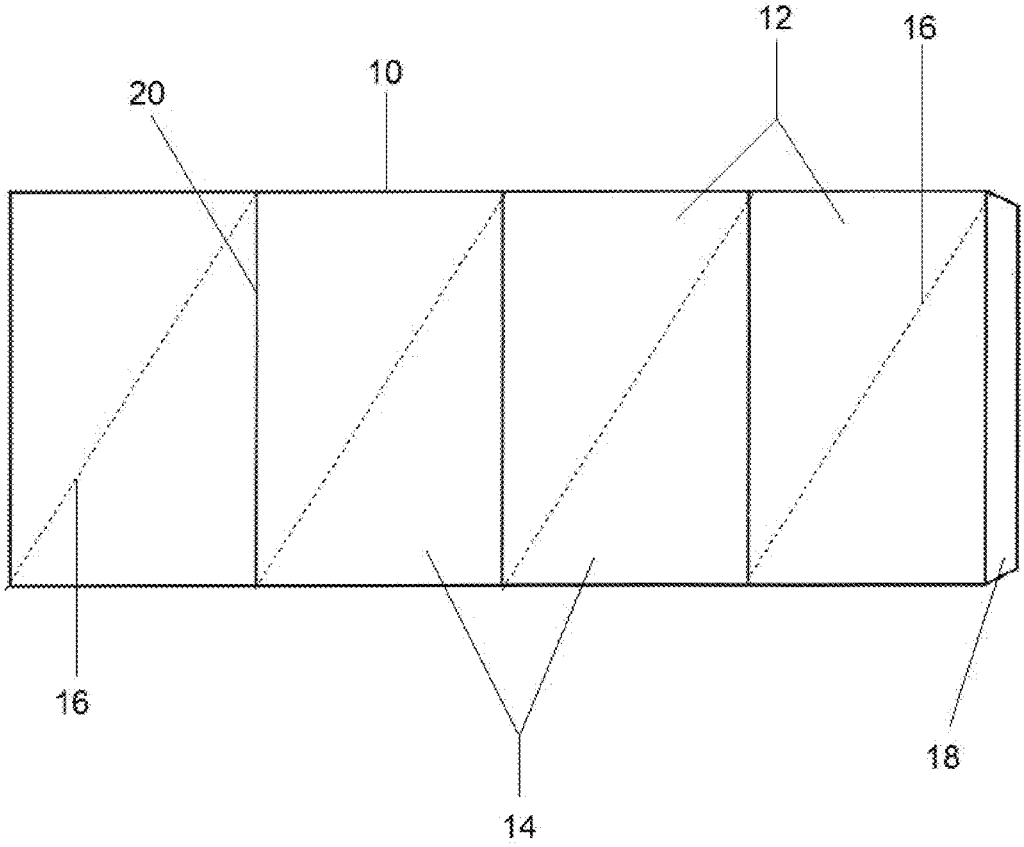
FIG. 1 is a blank of the product display.

The invention is directed toward a foldable blank for a product display and a folded product display. Referring to FIG. 1, the preferred embodiment of the display blank 10 is illustrated. The display blank 10 may be made from any material. In the preferred embodiment the display blank 10 is composed of cardboard. In other embodiments, the display blank 10 is made from a thermoplastic material, metal, paper, or any other commercially available structural material. In the preferred embodiment the display blank 10 is an elongate rectangular sheet of thin material which can be folded into the specific shape of the product display. The display blank 10 may be any size, thickness, length, width, or shape.

In the preferred embodiment the display blank 10 has a plurality of plurality of upper triangles 12. The upper triangles 12 may be any size or shape. The preferred embodiment also has a plurality of lower triangles 14. The lower triangles 14 may be any size or shape. In one portion of the display blank 10, the upper triangle 12 is connected to the lower triangle 14 by a shared hypotenuse 16. The shared hypotenuse 16 may be a fold point in the material. In another embodiment the shared hypotenuse 16 is a perforation in the material. The shared hypotenuse 16 is at a predetermined angle to the width of the display blank 10. Each hypotenuse 16 may be at a separate predetermined angle to the width of the display blank 10. In the preferred embodiment each hypotenuse 16 is at the same predetermined angle.

In another portion the of the display blank 10, the lower triangle 14 is connected to a second upper triangle 12 by a shared side 20. The shared side 20 is parallel to the width of the display blank 10. The shared side 20 may be a fold in the material. In another embodiment the shared side 20 is a perforation in the material.

At one end of the display blank 10 is a tab 18. The tab 18 may be any size and shape. In other embodiments there are a plurality of tabs 18. The tab 18 is utilized to permit the display blank 10 to be folded into a three-dimensional shape. In the three-dimensional shape the tab 18 is glued to the opposite end of the display blank 10. The tab 18 may be secured to the opposite end of the display blank 10 in any manner of known means, such as glue, staples, tape, ultrasonic welding, heat sealing, or any other commercially available means.

In the preferred embodiment the display blank 10 has four upper triangles 12 and four lower triangles 14. In other embodiments there may be any number of upper triangles 12 and lower triangles 14. The number of upper triangles 12 and lower triangles 14 determines the ultimate number of sides of the folded product display.

Figure 2:
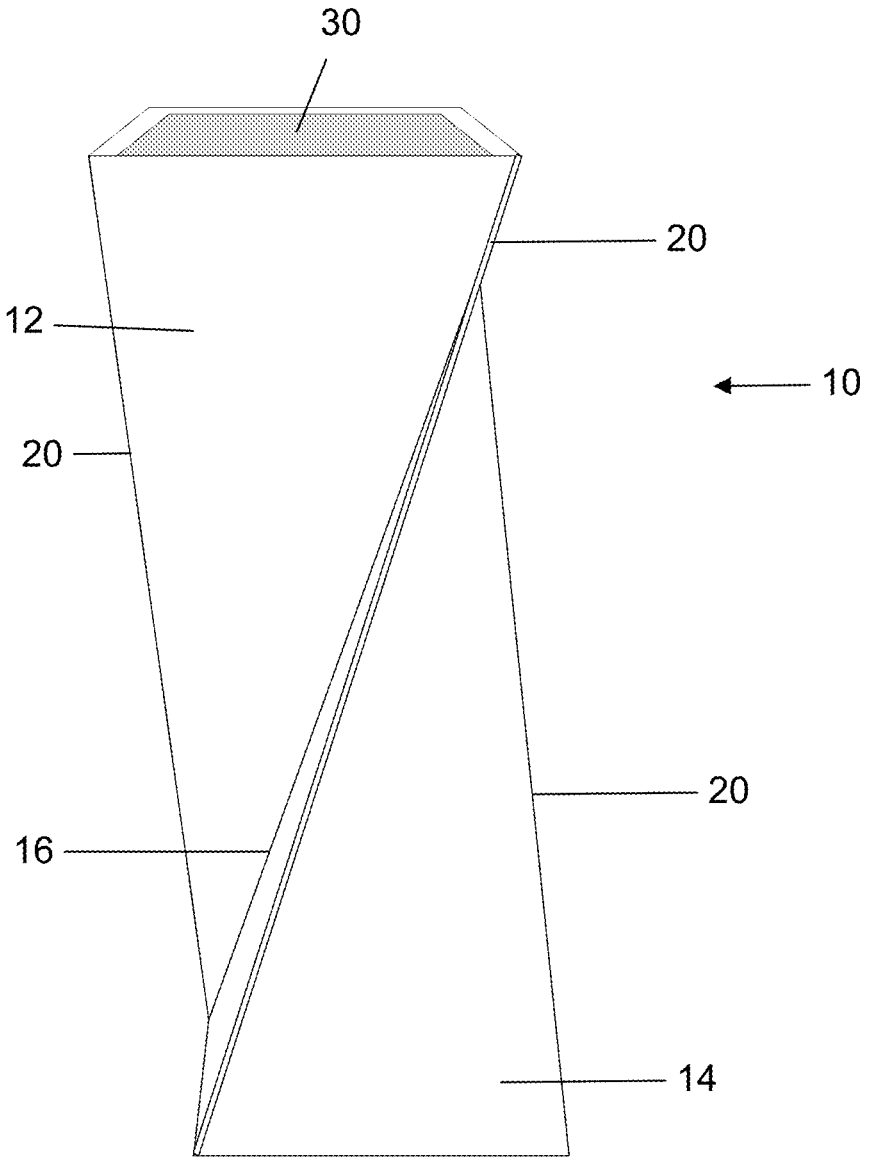
FIG. 2 is a side perspective view of the product display.
Figure 3:
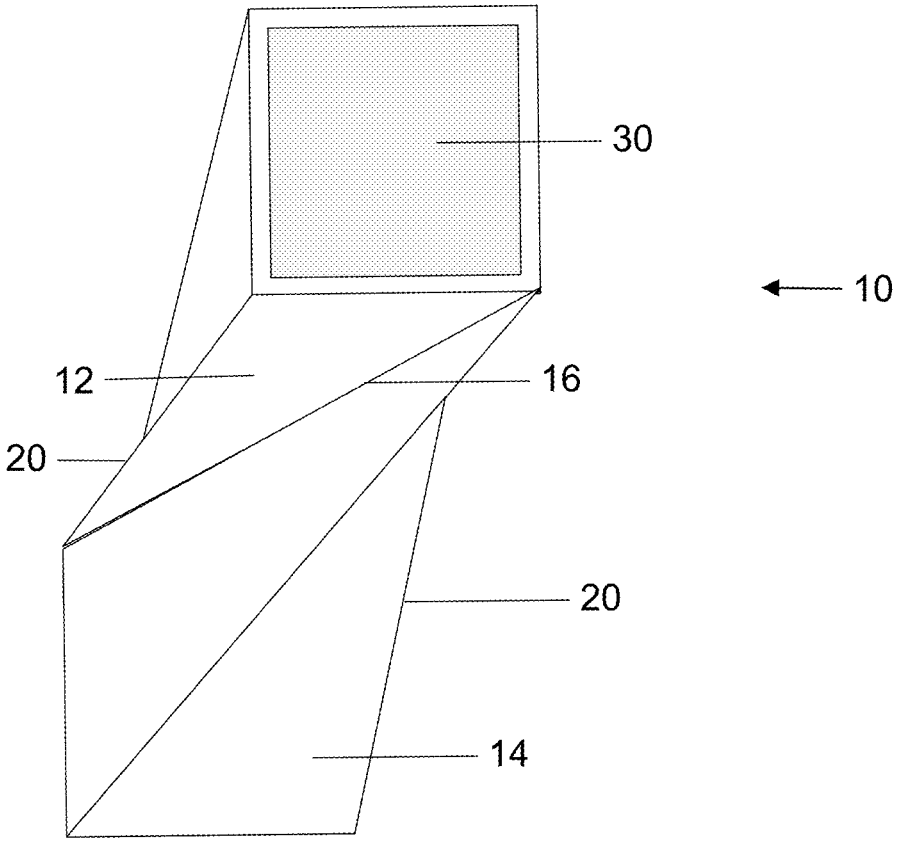
FIG. 3 is a top perspective view of the product display.

Referring to FIG. 2 and FIG. 3, the folded, three-dimensional configuration of the product display is illustrated. In the folded, three-dimensional configuration the product display has inner diagonal lines formed by each hypotenuse 16. The inner diagonal lines formed by each hypotenuse 16 extend laterally into the body of the display. The product display has outer diagonal extensions formed by the shared sides 20. The outer diagonal extensions formed by the shared sides 20 extend laterally outward from the body of the display.

The product display has a lower pyramid shape to provide a standing base for the product display. The product display has an upper inverted pyramid shape to hold the selected product. The product display has an internal holding portion 30 which is utilized to hold any chosen product. In the preferred embodiment, the product display is utilized to hold loose material. In other embodiments products may be in specialized shape boxes to complement the shape of the product display.

In the preferred embodiment shown in FIG. 2 and FIG. 3, the top of the product display has a square cross sectional shape. The bottom end of the product display also has a square cross sectional shape. In the folded configuration, a corner of the top square is connected to the corner of the bottom square that is rotated ninety degrees from the corner of the top square by the outer diagonal extension formed by a shared side 20. The same corner of the top square is also connected to the corner of the bottom square that is rotated one hundred eighty degrees from the corner of the top square by the inner diagonal line formed by a hypotenuse 16.

In some embodiments of the invention any upper triangle 12 and any lower triangle 14 may have sections cut out from the middle, thereby creating a hole through which materials and products may be inserted or withdrawn from the product display.

In the preferred embodiment there are four upper triangles 12 and four lower triangles 14. The number of upper triangles 12 and lower triangles 14 determine the number of sides of the folded product display. In the preferred embodiment the product display has a square cross section. In other embodiments the blank may have more than four upper triangles 12 and more than four lower triangles 14. The additional upper triangles 12 and lower triangles 14 changes the cross sectional shape of the product display such that the cross sectional shape may be any polyhedron shape.

What has been described above includes examples of the claimed subject matter. It is, of course, not possible to describe every conceivable combination of components or methodologies for purposes of describing the claimed subject matter, but one of ordinary skill in the art can recognize that many further combinations and permutations of such matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

The invention claimed is:

1. A blank of material to be folded into a product display container a) wherein said blank is substantially rectangular in shape having a first edge, a second edge opposite of said first edge, a third edge disposed adjacent to said first edge and said second edge and a fourth edge disposed opposite said third edge;
   i) wherein said first edge and said second edge extend along a length of said blank;
   ii) wherein said third edge and said fourth edge extend along a width of said blank;

b) said blank comprising
   i) a tab disposed adjacent to said fourth edge;
   ii) a first surface and a second surface disposed on an opposite side from said first surface;
   iii) a plurality of perpendicular folds, wherein each perpendicular fold extends across said width of said blank for an entire distance from said first edge to said second edge and is disposed substantially perpendicular to said first edge and said second edge;
   iv) a plurality of angular folds, wherein each angular fold extends across said width of said blank for an entire distance from said first edge to said second edge and is disposed at a non-perpendicular angle with respect to said first edge and said second edge;
   v) wherein a first end of each angular fold is disposed at a first end of a first respective perpendicular fold along said first edge;
   vi) wherein a second end of each of said angular folds is disposed at a second end of a second respective perpendicular fold along said second edge;
   vii) wherein each of said angular folds project outward from said first surface; and
   viii) wherein each of said perpendicular folds project outward from said second surface.

2. The blank as in claim 1 further comprising four angular folds.

3. The blank as in claim 2 further comprising four perpendicular folds.

4. The blank as in claim 3 further comprising one or more apertures.

5. The blank as in claim 3 wherein said blank is formed from cardboard.

6. The blank as in claim 1 further comprising four perpendicular folds.

7. The blank as in claim 1 further comprising one or more apertures.

8. The blank as in claim 1 wherein said blank is formed from cardboard.

* * * * *